United States Patent [19]

Pilié et al.

[11] Patent Number: 4,485,489

[45] Date of Patent: Dec. 4, 1984

[54] ENTRANCE AND EGRESS SYSTEM FOR PROTECTIVE SHELTERS AND GARMENTS

[75] Inventors: Roland J. Pilié; Norris E. Shoemaker; Charles K. Akers, all of Williamsville, N.Y.

[73] Assignee: Calspan Corporation, Buffalo, N.Y.

[21] Appl. No.: 390,100

[22] Filed: Jun. 21, 1982

[51] Int. Cl.[3] ..... A62B 17/00; A41D 13/00

[52] U.S. Cl. ..... 2/2; 2/69; 128/1 R

[58] Field of Search ..... 2/2, DIG. 7, 69, 74, 2/2.5; 128/1 R, 1 B; 223/111

[56] References Cited

U.S. PATENT DOCUMENTS

| | | | |
|---|---|---|---|
| 1,938,685 | 12/1933 | Breuls et al. | 223/111 |
| 1,996,397 | 4/1935 | Hinchen | 223/111 |
| 2,717,437 | 9/1955 | De Mestral | 28/72 |
| 2,813,022 | 11/1957 | Moulthrop | 2/2 |
| 2,985,129 | 5/1961 | Kirkpatrick | 2/2 X |
| 3,355,230 | 11/1967 | Trexler | 312/1 |
| 3,439,966 | 4/1969 | Perkins et al. | 312/1 |
| 3,473,167 | 10/1969 | Jeffrey | 2/74 |
| 3,501,213 | 3/1970 | Trexler | 312/1 |
| 3,526,066 | 9/1970 | Hagar et al. | 52/27 |
| 3,670,718 | 6/1972 | Brendgord | 128/1 R |
| 3,744,055 | 7/1973 | Brendgord | 2/2 |
| 3,802,416 | 4/1974 | Cazalis | 128/1 R |
| 4,002,276 | 1/1977 | Poncy et al. | 223/111 |
| 4,302,848 | 12/1981 | Otsuka et al. | 2/2 |
| 4,304,224 | 12/1981 | Fortney | 2/DIG. 7 X |
| 4,339,163 | 7/1982 | Jacobson et al. | 128/1 R |

FOREIGN PATENT DOCUMENTS

| | | |
|---|---|---|
| 1000674 | 8/1965 | United Kingdom . |
| 2020164 | 11/1979 | United Kingdom . |

*Primary Examiner*—H. Hampton Hunter

*Attorney, Agent, or Firm*—Biebel, French & Nauman

[57] ABSTRACT

A system is provided for safe passage of personnel between a pair of protective enclosures, at least one of which is portable such as a garment or a mobile unit, and which afford a protective environment to persons or things therewithin. The enclosures comprise an eveloping structure having at least one flexible panel, and the enclosures are adapted to be brought into a position with panels abutting. A first opening is formed in one of said panels and a second opening in the other panel, the openings being dimensioned and arranged to be coextensive when said panels are in abutting position, and primary fasteners, such as zippers, are attached to each of the openings for repeated opening and closing thereof. Secondary covering fasteners, including flaps with fabric hook-latch material, are on the exterior of each of the panels surrounding and totally covering the primary fasteners. The flaps and secondary fasteners cooperate when opened to interengage and to fasten the panels together with the openings aligned, permitting controlled opening of the primary fasteners and thus forming a passage between the interiors of said enclosures. Provisions are made to decontaminate the regions normally covered by the flaps, if necessary. One of the enclosures may be a protective shelter including a compartment having one or more of such flap covered and zippered openings, and also including hangers on its exterior to hold garments which personnel have shed in entering through such openings.

13 Claims, 13 Drawing Figures

ENTRANCE AND EGRESS SYSTEM FOR PROTECTIVE SHELTERS AND GARMENTS

BACKGROUND OF THE INVENTION

This invention relates to the rapid and safe movement of encapsulated individuals and/or materials into and out from protective structures. Encapsulation may consist, for example, of protective garments for personnel or suitable wrappings for packages. Protective structures may consist, for example, of military collective protective systems designed to protect troops from chemical warfare attacks, buildings, aircraft, spacecraft, or even an individual protective garment. Historically, everyone concerned with collective protective structures is aware of the major logistic problems in moving people and objects in and out of shelters.

Within the scope of personnel protection against a chemically contaminated environment, such as would result from a chemical warfare attack, individual protection receives a high priority. The encapsulation of personnel in a protective garment with a face mask, respiration system, etc., is very effective. However, the garment and respiration system can produce physiological and thermal stresses in combination with limited filter capacity, thereby severely limiting and restricting the effective wear duration. In order to control and limit the wear cycle for individual protection garments in the contaminated environment increasing emphasis has been placed on collective protection shelters for longer terms.

A presently accepted method to be reasonably sure the contamination will not get into such a collective main shelter is by requiring that all entry and egress of personnel be made via an airlock system. The airlock concept requires a minimum of two doorways and a separate intermediate compartment, sufficiently large to accommodate such functions as decontamination, undressing, and storage of contaminated garments. The airlock concept also greatly increases the demand for filtered air for ventilating and purging of the airlock compartment. This additional requirement results in a major increase in the size and cost of the air purification equipment necessary to operate the collective protection system.

It is generally agreed that one of the major problems associated with present collective protection structures is the logistics of rapid and safe entry of personnel or movement of equipment or stores into shelters when exposed to chemical agents. Typically a large time interval (10 to 15 minutes) is now required per person to execute safely and completely the entry procedures for a shelter equipped with a conventional positive pressure airlock system.

A number of patents have issued on special suits or systems that disclose variations on the airlock concept. Among these are U.S. Pat. Nos. 4,302,848; 3,355,230; 2,813,022; 3,744,055; 3,439,966; 3,501,213; 3,670,718; 3,802,416 and British No. 1,000,674. However none of this prior art offers a simple, re-usable, direct and rapid entry/egress system.

SUMMARY OF THE INVENTION

The present invention encompasses a new approach, a single-stage rapid entry and egress system. This system uses a novel air-lockless concept to replace the conventional airlock system now used in conjunction with collective protection shelters, and enables a person or package equipped with a suitably designed protective garment (or wrapping) to complete the entry process, and also provides for multiple entries and exits to occur simultaneously, while reducing significantly the time required for this operation. This is so because several airlock procedural stages can be eliminated or reduced; such items include decontamination and special storage of the outer garments, purging time for the airlock compartment and body or package decontamination. The simplified approach of the present invention in some respects reduces the entry procedures to a two-dimensional operation from a three-dimensional one, because the entry process only involves the interface between the mating outer surfaces of both the protective garment and the protective shelter.

The objective of the invention is to "skin" the individual (package) from his (its) protective outer garment (wrapping) and immediately and safely transfer him inside the collective protection shelter, leaving his (its) contaminated garment (wrapping) on the outside. To accomplish this transfer, mating normally closed and covered openings are provided on the garment and on the shelter entrance wall. When mated and each opened, the pair comprises a single opening which provides free transfer from one contamination-free space to the other. Hereinafter, the words "individual", "personnel" and "garments" are intended to include in their meaning "packages" and "wrappings".

The invention utilizes a combination of mating primary fasteners, such as zippers, and flaps with additional or secondary fasteners, such as fabric hook-latch tvpes, located on both the exterior of the shelter entrance wall and the outer protective personnel garment, to cover the primary fasteners. These features enable the individual to secure (or have secured) his outer garment to the exterior of the shelter entrance and also provide a seal for the passageway between the interior area of both the garment and the collective protective shelter compartment, thereby excluding any contamination from the outside environment. Once the attachment is accomplished, the garment and compartment primary fasteners, now located within the sealed non-contaminated interior area surrounded by the attached flaps, can be opened in sequence by the person from inside his garment (or from inside the shelter).

The sequence of events to accomplish the rapid entry process is thus: (1) approach the shelter entrance, (2) secure garment to the entrance, (3) step into the shelter, (or transfer package into the shelter) and (4) leave the outer garment stored on the outside for reuse.

For personnel entry/exit the garment may be designed with the opening extending from the shoulder to approximately the knee, and boot clamps and a mask hook may be provided on the exterior of the shelter compartment to help secure the outer garments to the ouside of the shelter wall. These features also guide the individual mating surfaces of the secondary fasteners to proper alignment and aid the individual in stepping out of the protective garment. Several other designs have been considered to accomplish entry under special circumstances, but for brevity will not be described here.

Once inside the shelter compartment the individual protective garment is temporarily a part of the shelter outside wall. The inside of both the garment and collective shelter are respectively sealed from the contaminated or non-life sustaining environment as previously described. The sealing effectiveness can be enhanced by positive pressure maintained within the shelter; any airflow (leakage) is thereby from the inside to the outside of the shelter and garment. Only interior garment surfaces would be exposed to the interior structure wall area, thereby precluding transfer of contamination.

After entering the collective protection shelter, both interior or primary zipper fasteners can (but need not) be closed, while the garment remains on the exterior of the collective protection structure. After protected functions in the shelter are completed (e.g. eating, bodily functions, sleeping, etc.), the individual can reopen both interior zippers, reenter his garment, close zippers, and separate himself from the collective protection structure while closing the flaps and secondary fasteners, to safely continue his duties in the exterior contaminated environment. A single collective protection compartment can be equipped with several entrance systems, for example with the total equal to the number of personnel it is intended to protect at any one time. The invention thus does not restrict the number of personnel entering or leaving the shelter at any one time, and effectively provides a parallel entry/egress system rather than an essentially serial system.

Numerous applications of the basic concept for transferring personnel and equipment from one protected area to another include, entry and egress to military ground vehicles, amphibious vehicles, boats, aircraft and onboard ships. Other applications are casualty handling in the field, and providing for food, drink, and personal hygiene requirements to people in protective garments. The protection afforded by the shelter compartments and/or garments can be against gaseous or liquid agents, or radiation, excessive heat or cold, harmful to humans, or with respect to an environment which is simply non-supportive of human life.

Thus, the object of the invention is to provide a system and method for safe passage between a pair of protective enclosures, at least one of which is portable, such as a garment, wrapping (cover), or mobile unit, and which afford a protective environment to persons or items therewithin, said enclosures each comprising an eveloping structure and being adapted to be brought in position such that the panels abut, a means defining openings in the panels dimensioned and arranged to be co-extensive (or jointly removed) when the panels are in abutting position, primary fasteners such as zippers attached to each of the openings for repeated opening and closing thereof, secondary fasteners including flaps with hook-latch fabric or the like on the exterior of each of the panels surrounding and totally covering the primary fasteners means, and the secondary fasteners being cooperative when opened to interengage and to fasten the panels together with the openings aligned permitting controlled opening of the primary fasteners and thus forming a passage between the interiors of the enclosures; to provide such a system wherein the portable enclosure is a wrapping for package or equipment or a garment to be worn by a person and the opening in the wrapping or garment is of a size sufficient to accommodate passage of the package or person; to provide such a system wherein the other enclosure may be a pouch or wrapping containing protected items such as tools or nourishment, or for disposal of waste, or another garment into which the person can transfer; to provide such a system wherein the other enclosure is a compartment into which the person or items can transfer, such compartment having one or more openings each adapted for connection to a protective wrapping or garment, and optionally including hanger means on the exterior of the compartment adjacent each of said openings for retaining a garment or wrapping in position with the panels connected while the wrapping or garment is vacant.

Other objects and advantage of the invention will be apparent from the following description, the accompanying drawings and the appended claims.

DESCRIPTION OF THE PREFERRED EMBODIMENT

Figure 1:
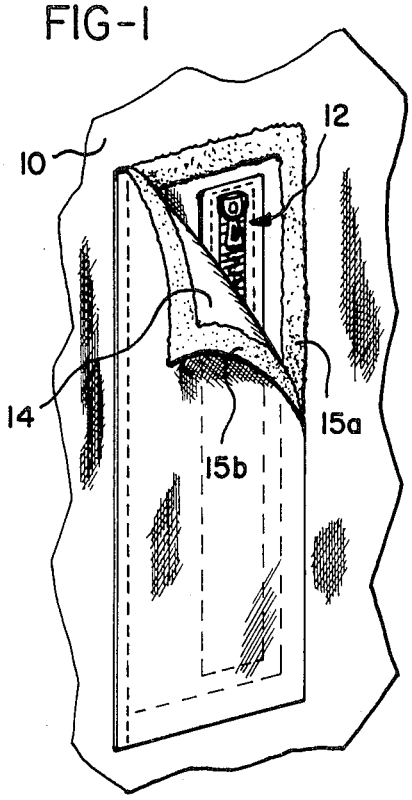
FIG. 1 is a perspective view of one panel with the secondary fastener flap open.
Figure 2:
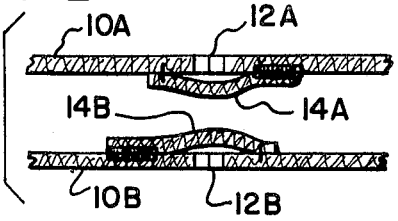
FIGS. 2–5 are diagrammatic partial cross-section views showing the sequence of opening the secondary fasteners and mating them, then opening the primary fasteners to form a passage.

Referring to FIGS. 1–7 of the drawings, which illustrate a preferred embodiment of the essential features of the invention, FIG. 1 shows a segment of a panel 10 of a flexible material, in which an elongated slit-like opening is formed, closed by a primary fastener 12 which is illustrated schematically as a zipper, and which may have tabs on both sides for operation from either side of the panel. Fastened to the panel 12, along one side of the zipper, is a flap 14 which is sealed to the surface of the panel 10 along a line which also defines the hinge of the flap 14.

The flap is sufficient in dimension to be folded completely over and beyond the zipper, and the face of the flap which folds toward the panel surface, along with the surface of the panel surrounding the zipper, and onto which the free edges of the flap engage, are provided with a secondary fastener which is indicated by reference numerals **15*a* and 15*b*, being the complementary parts a secondary fastener means which may be, for example, a hook-latch type of fastener such as disclosed in U.S. Pat. No. 2,717,437 issued to Velcro S. A. This type of fastener device is per se well known. It should be noted that the flap, together with the secondary fastener 15*a*–15*b*, provides a secondary fastener means that covers the slit-like opening in the panel and totallv surrounds the primary fastener means or zipper 12. Thus, if the exterior of the panel 10 is exposed to a contaminated environment, the flap 14** totally covers and protects the primary fastener means and the surrounding region covered by the closed flap.

In accordance with the invention two complementary devices such as above described, and shown in FIG. 1, are provided on a pair of protective enclosures, at least one of which is portable and may be a garment or suit, a package, or or a panel on an enclosed vehicle. FIGS. 2–5 illustrate the sequence of mating the panels of the two enclosures in order to form quickly a passageway between the enclosures. Thus, in FIG. 2 the upper panel 10A is shown with its flap 14A closed and its primary zipper fastener 12A closed, while a complementary device including a panel portion or section 10B having a closed primary zipper fastener 12B, and a closed secondary fastener means including flap 14B, is brought into essentially face-to-face relationship with the panel section 10A.

Figure 3:
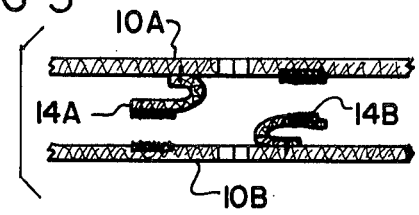
Figure 4:
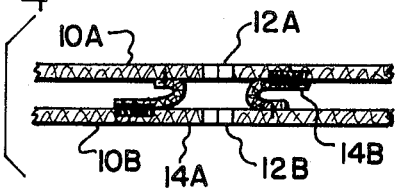

In FIG. 3, the flaps 14A and 14B are opened. It will be noted that at this time the fastener means on the two panels are arranged in complementary fashion; that is, the hook material on the flap, for example, is aligned with the latch material on the surface of the opposite panel section. These are pressed together, as shown in FIG. 4, thereby providing a rather narrow elongated and totally surrounded protective area 17 as shown in FIG. 4, with the primary fastener zippers still closed. In the event that the few moments of opening the two flaps might allow some contaminate to enter the region beneath the flaps and around the zippers, a decontaminate agent can be introduced by, for example, having a suitable decontaminate available within this region in a frangible capsule or the like, should this precaution be necessary.

Figure 5:
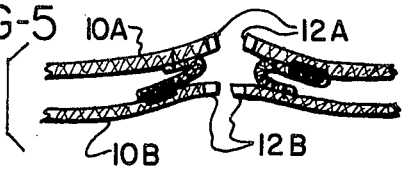
Figure 6:
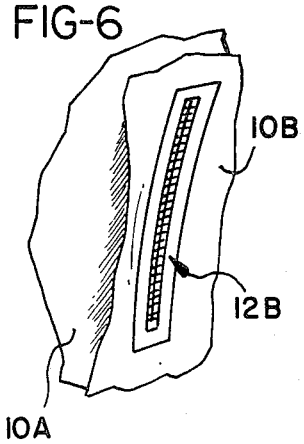
FIGS. 6 and 7 are perspective views of the joined panels with the passage closed and open.
Figure 7:
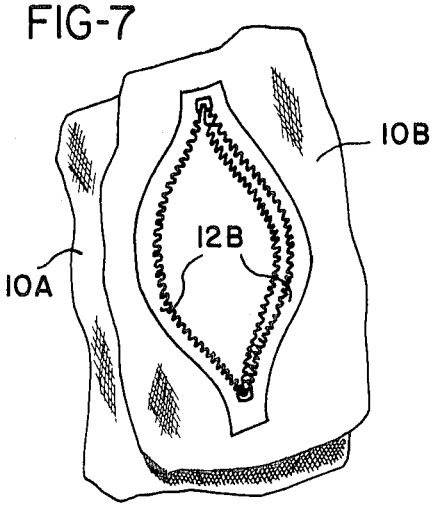

With the two panels attached by way of the flaps 14A and 14B, the primary fasteners or zippers can now be opened, as shown in FIG. 5, resulting in a direct passageway or opening between the two enclosures of which the panels 10A and 10B form a part. FIG. 6 is a perspective view which illustrates the attachment of the two panel sections as viewed from the inside of one of the enclosures with the primary fastener or zipper closed, and FIG. 7 shows this arrangement with the zippers open and the opening flexed apart, thereby providing a passage between the two enclosures which can be distended as necessary to accommodate movement of material and/or personnel through the resultant controlled opening.

Figure 8:
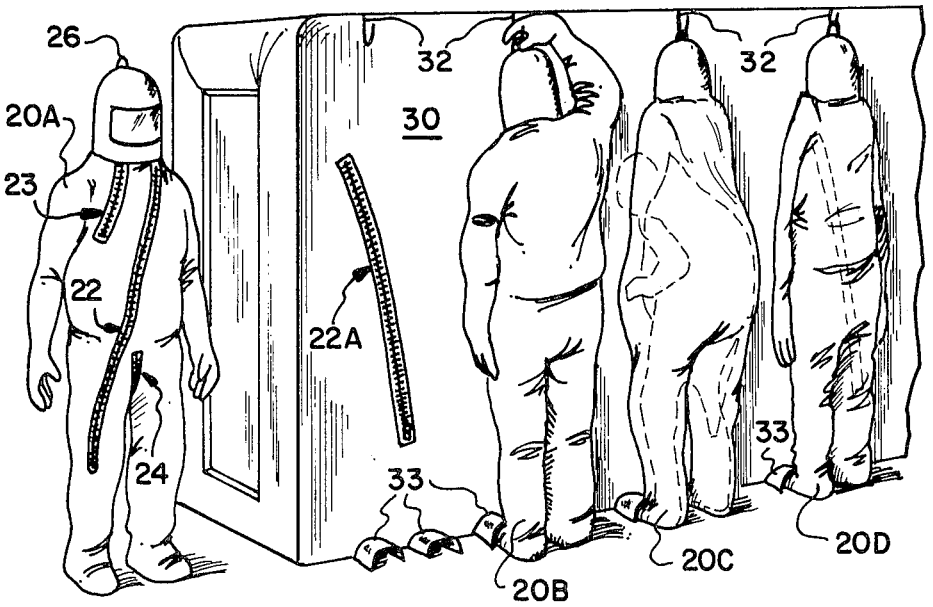
FIG. 8 is a drawing of a shelter compartment and several garments, also showing a person exiting a garment into the compartment.

FIG. 8 illustrates one typical application of the invention wherein personnel are provided with protective garments or suits 20A, 20B, 20C and 20D, each of which includes a helmet portion with a visor, a flap-sealed main opening 22, optional additional smaller flap-sealed openings 23 and 24, together with arms and legs, gloves, and foot coverings (boots) which totally envelop the wearer. A retainer loop 26 may be attached to the top of the helmet part, or other appropriate location on the garment for use as later described. In the illustration, the four garment enclosures provide protection for four persons while they function within the environment outside a protective shelter which includes a panel having appropriate openings 22A that are flap covered and closed, as previously shown and described. The shelter 30 can be a small protective collective enclosure or a vestibule leading into a larger safe shelter. Above each opening, as above 22A, or at other appropriate location surrounding openings 22A, there is provided a hook 32 which can be interengated with the loop 26 on the garment, and inverted guides 33 are provided at the base of the shelter 30 below opening 22A, adapted to receive the two portions of the boot parts of the garments.

In FIG. 8 the four garments 20A–20D are shown in different stages of use, the person in garment 20A being independent of the shelter 30 and approaching the closed flap-covered opening 22A. The person in garment 20B is shown attaching the hook to the loop on the helmet part of the garment with the boot parts inserted into the guides 33. Subsequent to this step, the person opens the secondary fastening means (such as flaps 14A and 14B which correspond to the flaps on openings 22 and 22A) and after pressing the flaps together to seal them to the opposite panels, and decontaminating the region undercovered by the flaps if necessary, the person can then open the primary zipper fasteners in the garment, then open the zipper fastener in the panel of the shelter, and step through the resultant open passageway to the interior of the shelter as shown in dotted lines with the garment 20C. The garment (such as 20D) is then left attached to the exterior of the shelter, hanging in position, preferably with the primary or zipper fasteners closed, available for further use by the same or other personnel.

Figure 9:
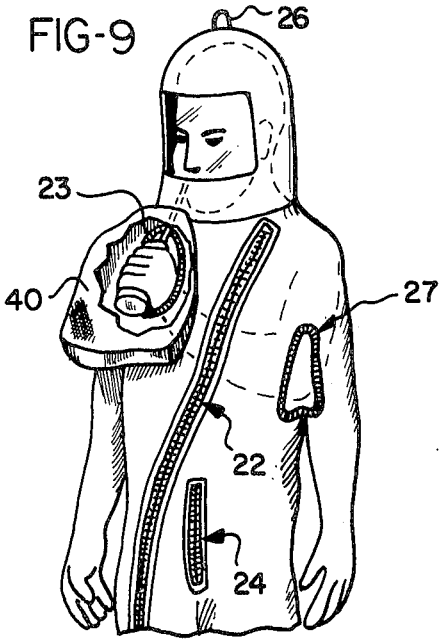
FIG. 9 shows a person within one of the garments using a pouch to obtain nourishment.

FIG. 9 illustrates another application of the invention, wherein nourishment such as a beverage is provided totally enclosed within a protective pouch 40 having a smaller flap-covered and sealed opening corresponding to the smaller opening 23 on the garment. The wearer of the garment can pick up the pouch, attach the flaps, open the zippers, and then reach into the pouch and withdraw the container, and when finished drinking (or eating) dispose of the resultant waste in like manner by reversing the process. The flap covered openings 24 in the garments may be utilized in similar fashion to provide for elimination of body waste. FIG. 9 also illustrates an optional sleeve expansion zipper 27 which when opened provides adequate fabric under the arm to permit extraction of the arm from the sleeve to operate zippers 22, 23 or 24 from inside of the uniform, but when closed permits reasonably form fitting apparel that is appropriate for unrestricted actvity.

Figure 10:
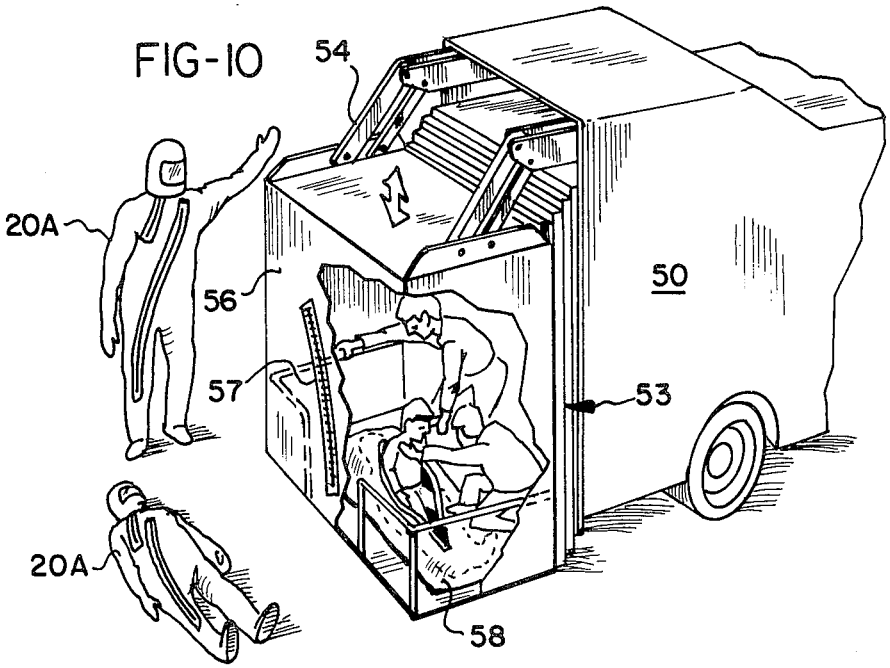
FIGS. 10 and 11 show a mobile compartment interacting with a garment and with a stationary compartment to pick up and transport disabled personnel.
Figure 11:
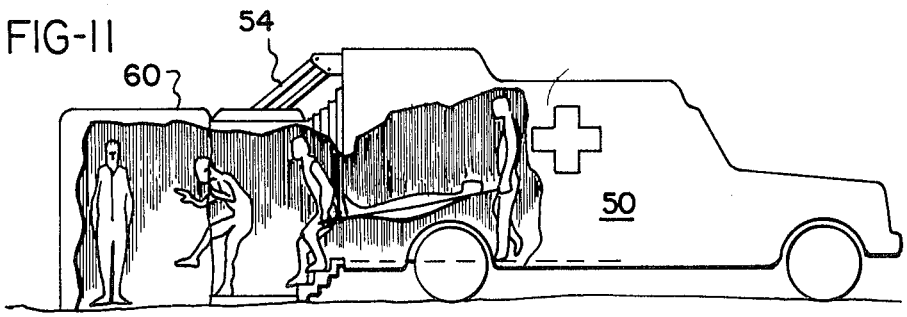

FIG. 10 and FIG. 11 illustrate a further application of the invention in connection with the retrieval of ill or injured personnel from the non-life sustaining environment where they are enclosed within a protective garment, but unable to attach their garment to a more permanent shelter in the manner previously described. In FIG. 10 a sealed ambulance or retrieval vehicle 50 is shown having a rear compartment 52 provided with panels which contain the same form of flap covered zippered contolled openings. The compartment is attached to the main body of the vehicle by a sealed bellows structure 53, and the compartment may be moved vertically through power operated lift mechanism shown schematically at 54.

In the example shown in FIG. 10 the compartment 52 has a back panel 56 with an opening 57 and a bottom panel 58 with a controlled opening 59 which is shown open, attached to a garment from which an injured person is being removed by attendants operating within the safety of the compartment 52. A further immobilized person is shown lying on the ground with his protective garment in place. With the assistance of a person outside the vehicle in a protective garment, should this assistance be necessary, the attendants can direct the movement of the vehicle such that the compartment 52 is located over the immobilized person outside, then the compartment can be lowered and the opening 58 aligned with the closed opening on the garment of the immobilized person. The sequence of FIGS. 2–5 is then followed to allow the person to be pulled within the shelter of the compartment 52, and placed within the body of the vehicle 50, on a stretcher if necessary. The bottom panel 58 may be provided with integral arm and glove attachments (not shown) to enable personnel within compartment 52 to manipulate the fasteners as necessary to perform this task.

FIG. 11 illustrates use of the same vehicle and compartment, having been brought into face-to-face relation with a shelter 60 which may be the vestibule to a field hospital. The opening 57 on the back of the compartment 52 has been mated with a like opening in a side wall panel of the shelter 60. The attendants can then remove the personnel which have been collected from the field, on stretchers if necessary as shown, through the resultant opening into the safe and life-sustaining interior of the shelter 60.

It will be appreciated by those skilled in the art that many additional uses of the invention are available. Personnel can change from one garment to another, or exchange food, tools, and other items using the aforementioned pouches.

Figure 12:
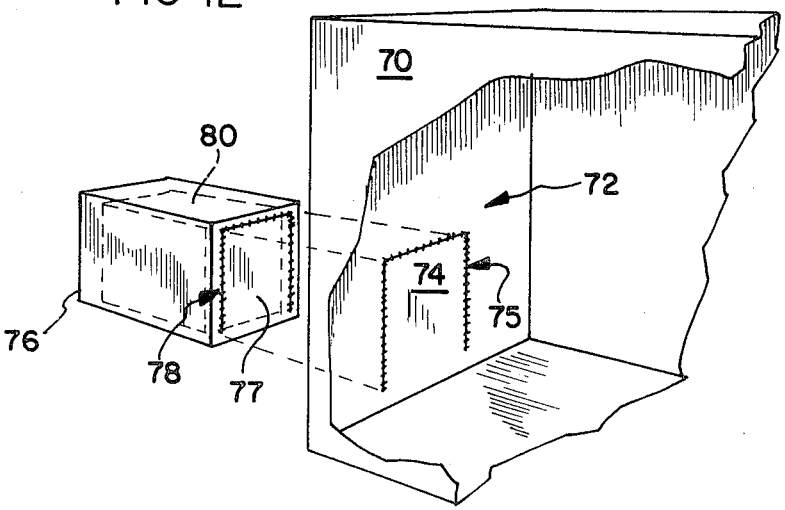
FIGS. 12 and 13 are perspective views of a package being transferred from its wrapping into a protective compartment and illustrates one of several "zipper" configurations useful for equipment transfer. Another configuration would have the zipper continue, around the fourth side of the two flaps so that the flaps could be completely removed and out of the way for loading many objects into the wrapping such as if the wrapping were really the housing of a truck and the protective compartment really a warehouse.
Figure 13:
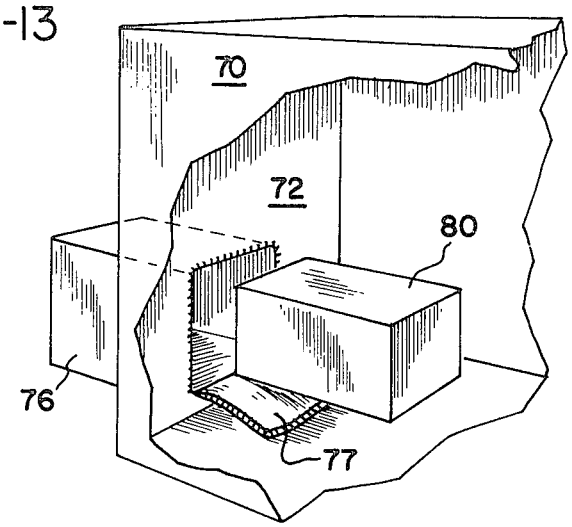

Referring to FIGS. 12 and 13, another form of the invention is shown in connection with a shelter compartment 70, the near wall of which is broken away to reveal in an end wall 72 a panel 74 which is surrounded on three sides by a two stage fastener 75, as previously described, the panel 74 remaining connected along its bottom to the larger wall 72 of the compartment. Outside the compartment 72 there is a rectangular box-shaped cover or wrapping 76 which has a like panel 77 surrounded by a two stage fastener 78 of the same outline configuration as the fastener 75.

The wrapping 76 is brought into contact with the compartment wall 72, the primary and secondary fasteners are open, and the panels 74 and 77 can be drawn into the compartment 72, providing an opening through which a container or other item 80 can be brought into the compartment or moved out of the compartment and secured within the wrapping 76. It is also possible, should there be a need to do so, to provide the primary and secondary fasteners on each of the fastener members 75 and 78 with a fourth side and to provide releaseable slides on the primary zipper fasteners. With such an arrangement the panels 74 and 77 can be completely removed if desired.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A system for attaching and detaching and providing safe passage between a pair of panels such as wall members of protective enclosures at least one of which is portable, and which may afford a protective environment to persons or items therewithin, said enclosures each comprising an eveloping structure having at least one panel, said enclosures being adapted to be brought in position such that said panels abut, means defining a first opening in one of said panels and a second opening in the other panel, said openings being dimensioned and arranged to be coextensive when said panels are in abutting position, fastener means attached to each of said openings and adapted for repeated opening and closing thereof, fastener flaps on the exterior of each of said panels surrounding and totally covering said primary fastener means, said flaps and fastener means being cooperative when opened to interengage and to fasten said panels together with said first and second openings aligned and thus forming a passage between the interiors of said enclosures.

2. A system as defined in claim 1, wherein the portable enclosure is a garment to be worn by a person.

3. A system as defined in claim 2, wherein the opening in the garment extends across the front thereof and is of a size sufficient to accommodate passage of the person.

4. A system as defined in claim 3, wherein the other enclosure is also a garment into which the person can transfer.

5. A system as defined in claim 3, wherein the other enclosure is a compartment into which the person can transfer.

6. A system as defined in claim 5, said compartment having a plurality of openings each adapted for connection to a protective garment.

7. A system as defined in claims 5 or 6, including hanger means on the exterior of said compartment adjacent each of said openings for retaining a garment in position with said panels connected while the person vacates the garment.

8. A system for providing safe passage between a pair of protective enclosures which afford a protective environment to persons or items therewithin, said enclosures each comprising a totally eveloping structure having at least one flexible panel, said enclosures being adapted to be brought in position such that said panels abut, means defining a first opening in one of said enclosures and a second opening in the other enclosure, a first fastener means attached to said first opening and adapted for repeated opening and closing thereof, second fastener means on the exterior of said one enclosure surrounding and totally covering said first fastener means, a third fastener means attached to said second opening and adapted for repeated opening and closing thereof, a fourth fastener means on the exterior of said other enclosure totally covering said second opening and cooperative with said second fastener means to fasten said panels together with said first and second openings aligned to permit controlled opening of said first and third fastener means and thus forming a passage between the interiors of said enclosures

9. A system for providing ingress or egress with respect to a suit which affords a protective environment to its wearer, said suit comprising a totally eveloping first portable enclosure, means defining a first ppening in said enclosure providing a passage from the interior to the exterior thereof, a first fastener means attached to said first opening and adapted for repeated opening and closing thereof, second fastener means on the exterior of said enclosure surrounding said first fastener means, a second enclosure inte ded for communication with the interior of said first enclosure and including means defining a second opening commensurate in size with said first opening, a third fastener means attached to said second opening and adapted for repeated opening and closing thereof, a fourth fastener means on the exterior of said second enclosure surrounding said second opening and cooperative with said second fastener means to fasten said first enclosure to said second enclosure with said first and second openings aligned to permit controlled opening of said first and third fastener means and thus forming a totally protected passage between said enclosures.

10. A system for providing safe passage into and out of a protective enclosure which affords a protective environment to a person or item therewithin, said enclosure comprising an eveloping structure having at least one flexible panel adapted to be brought into position abutting a like other panel, means defining a first opening in said panel dimensioned and arranged to be co-extensive with a like opening in the other panel when the panels are in abutting position, primary fastener means attached to said opening and adapted for repeated opening and closing thereof, secondary fastener mean on the exterior of said panel surrounding and totally covering said primary fastener means, said secondary fastener means being cooperative when opened to interengage with a like secondary fastening means on the other panel with the openings aligned permitting controlled opening of said primary fastener means and thus forming a closed passage from the interior of said enclosure.

11. A system as defined in claim 10, wherein the enclosure is a garment to be worn by a person.

12. A system as defined in claim 11, wherein the opening in the garment extends across the front thereof and is of a size sufficient to accommodate passage of the person.

13. A method for providing safe passage between a pair of protective enclosures, at least one of which is portable, and which afford a protective environment to persons or items therewithin, said enclosures each comprising an eveloping structure having at least one panel with an opening therein, said openings being dimensioned and arranged to be co-extensive when said panels are in abutting position and being controlled by fastener means attached to each of said openings and adapted for repeated opening and closing thereof, said fastener means including flaps on the exterior of each of said panels surrounding and totally covering said fastener means; the steps comprising releasing the secondary fastener means to open the flaps, bringing the flaps on one of the panels into abutting relation with the flaps on the other panel and interlocking the two fastener means to provide a connection between the panels surrounding the fastener means, and opening the fastener means to form a passageway between the enclosures which is surrounded and sealed by the interengaged fastener means.

* * * * *